US010633922B2

(12) United States Patent
Head

(10) Patent No.: US 10,633,922 B2
(45) Date of Patent: Apr. 28, 2020

(54) DIRECTIONAL MICRO LATERAL DRILLING SYSTEM

(71) Applicant: Octopus Completions LTD, Bagshot Surrey (GB)

(72) Inventor: Philip Head, Virginia Water Surrey (GB)

(73) Assignee: Octopus Completions Ltd., Surrey (GB)

( * ) Notice: Subject to any disclaimer, the term of this patent is extended or adjusted under 35 U.S.C. 154(b) by 0 days.

(21) Appl. No.: 15/751,811

(22) PCT Filed: Aug. 11, 2016

(86) PCT No.: PCT/GB2016/052506
§ 371 (c)(1),
(2) Date: Feb. 9, 2018

(87) PCT Pub. No.: WO2017/025755
PCT Pub. Date: Feb. 16, 2017

(65) Prior Publication Data

US 2018/0238145 A1 Aug. 23, 2018

(30) Foreign Application Priority Data

Aug. 11, 2015 (GB) ..... 1514207.8

(51) Int. Cl.
*E21B 7/06* (2006.01)
*E21B 7/00* (2006.01)
(Continued)

(52) U.S. Cl.
CPC ..... *E21B 7/061* (2013.01); *E21B 7/002* (2013.01); *E21B 7/04* (2013.01); *E21B 7/046* (2013.01); *E21B 7/06* (2013.01); *E21B 7/068* (2013.01); *E21B 29/06* (2013.01); *E21B 41/0035* (2013.01); *E21B 43/30* (2013.01)

(58) Field of Classification Search
CPC ... E21B 7/04; E21B 7/046; E21B 7/06; E21B 7/061; E21B 29/06
See application file for complete search history.

(56) References Cited

U.S. PATENT DOCUMENTS 4,640,353 A * 2/1987 Schuh ..... E21B 7/061 166/117.6
4,712,306 A 12/1987 Cahill et al.
(Continued)

FOREIGN PATENT DOCUMENTS

WO WO 95/33910 A1 12/1995
WO WO 2013/165612 A1 11/2013

OTHER PUBLICATIONS

International Search Report and Written Opinion for PCT/GB2016/052506 dated Oct. 14, 2016, 11 pages.

*Primary Examiner* — Tara E Schimpf
(74) *Attorney, Agent, or Firm* — Fay Sharpe LLP

(57) ABSTRACT

A flush of directional drilling apparatus for directionally drilling a lateral bore from a main bore, has a casing in the main bore, the casing having at least one lateral exit port, with a fragmentable plug, flush lateral directional drilling tube, and a pre-installed whipstock guide for guiding the flush lateral directional drilling tube into the lateral exit port to drill a directional lateral hole from the lateral exit port.

21 Claims, 18 Drawing Sheets

(51) Int. Cl.

| | |
|---|---|
| ***E21B 7/04*** | (2006.01) |
| ***E21B 29/06*** | (2006.01) |
| ***E21B 41/00*** | (2006.01) |
| *E21B 43/30* | (2006.01) |

(56) References Cited

U.S. PATENT DOCUMENTS

| | | | | |
|---|---|---|---|---|
| 5,785,133 | A * | 7/1998 | Murray | E21B 7/061 166/117.5 |
| 6,257,353 | B1 * | 7/2001 | Belew | E21B 7/061 175/2 |
| 7,357,182 | B2 * | 4/2008 | Hunt | E21B 7/18 166/298 |
| 2004/0226719 | A1 | 11/2004 | Morgan et al. | |
| 2008/0105438 | A1 * | 5/2008 | Jordan | C22C 1/0408 166/376 |

* cited by examiner

Plane A from figure 1

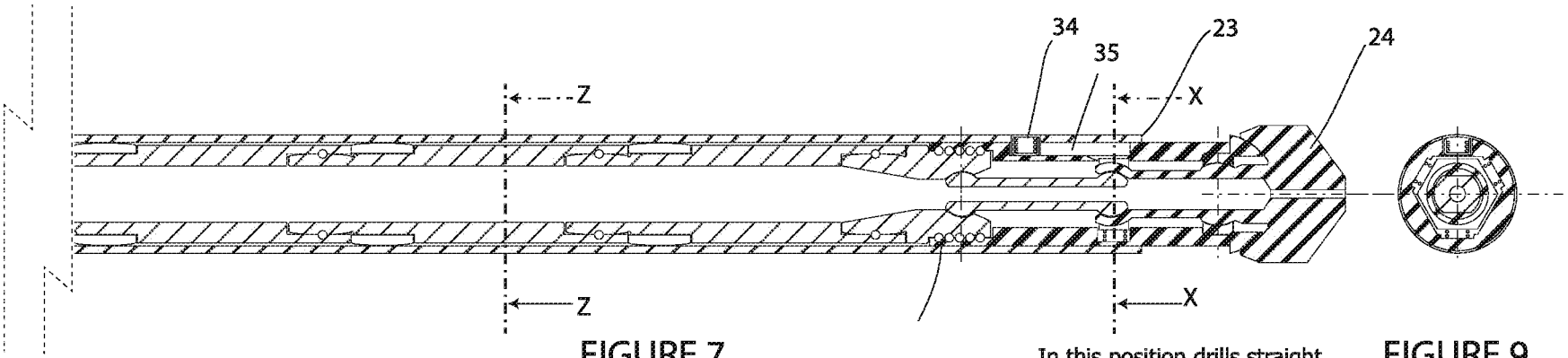
FIGURE 7
In this position drills straight
FIGURE 9
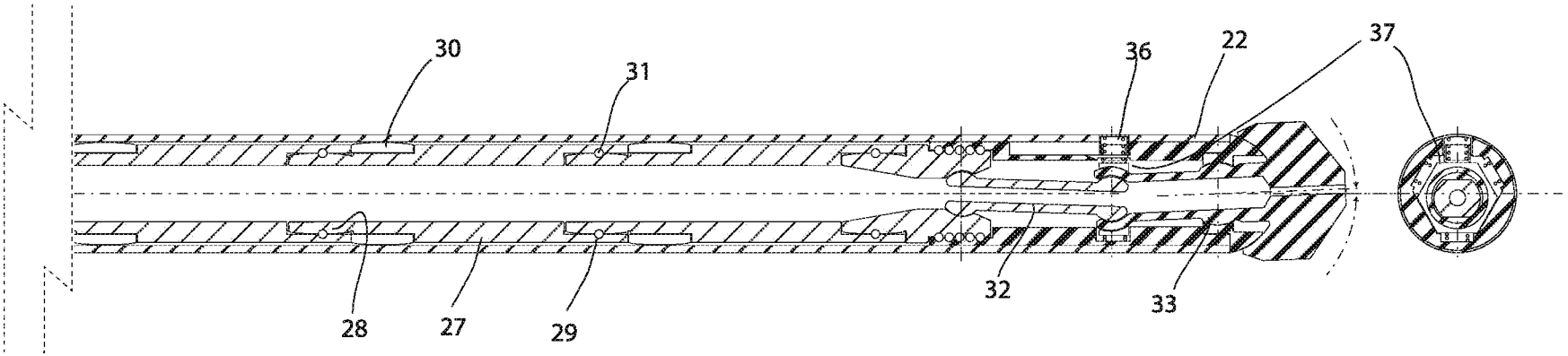
FIGURE 8
In this position drills directional in one of three directions
FIGURE 10

FIGURE 11 Index drilling head to point in 3 directions

Isometric View

Plan View

Section DD

Total of 6 positions
Crude directions control
A different sound is transmitted at each position to confirm change in direction
Fibre optic cable picks up this information

DIRECTIONAL MICRO LATERAL DRILLING SYSTEM

CROSS-REFERENCE TO RELATED APPLICATIONS

This application is a National Stage Entry of PCT/GB2016/052506, and claims priority to, and the benefit of, Great Britain Patent Application No. GB 1514207.8, filed Aug. 11, 2015, the entirety of which is hereby incorporated by reference as if fully set forth herein.

It is advantageous to drill a well horizontally through a reservoir and selectively isolate the annulus using swellable packers. That enables each zone to be selectively produced and stimulated using fracturing techniques to get the maximum production from the well.

However, fracturing uses significant quantities of fluids and a large high pressure pumping equipment spread at surface. In addition, the fracturing deep tight rock is generally not economic due to the large hydraulic pumping capacity required.

It is therefore the objective of this invention to create deep lateral holes in the reservoir of known size and depth, and distribution along the entire reservoir.

It is a further objective that these lateral holes are directionally drilled using a fluid powered directional drill fitted at the end of the flush OD tube.

It is a further objective that the outer tube is prevented from rotating while an inner tubular member provides torque to the bit.

It is a further objective to have exit ports with a fragment able material sealing the port which is easily drilled by the drill bit.

It is a further objective to have a orientated whipstock to guide the coiled tubing out of the port in a controlled and supported manor.

It is a further objective to have more than one exit port at a junction.

It is a further objective to have a smart whipstock which transmits a tone for the angle it is set for exit. This tone is different for every 1-2 degrees relative to vertical, a fibre optic cable in the wall of the coiled tubing detects the tone and a interrogator at surface can interrupt this information.

It is a further objective to have a noise transmitter in the whip stock, a distance below the whip stock, at the motor and at surface to enable the exact position of the coiled tubing in the lateral to be determined and therefore enable the micro lateral to be directionally drilled.

It is a further objective to have a directional drilling head, which can be pointed in a directional to enable the hole to be drilled in any direction.

According to the invention a flush OD tube has a internal torque transmitting assembly to the bit.

According to a further aspect of the invention, the bit can be pointed in a direction to directional drill the hole by simple axial movements of the outer coiled tubing.

According to a further aspect of the invention, the axial movement is achieved by a hydraulic piston powered from surface.

According to a further aspect of the invention more than one lateral can be drilled at one station.

According to a further aspect of the invention, more than one lateral can be drilled from each lateral that exits the main mother bore.

According to a further aspect of the invention, a fragment able plug seals the exit port. The exit port is located within a swellable packer.

According to a further aspect of the invention the fibre optic acoustics is used to determine the precise position of the coiled tubing in the micro lateral.

According to a further aspect of the invention, the whip stock transmits a tone relative to the angle of orientation the exit port is set.

According to a further aspect of the invention, assembly can drill ultra-short radius micro laterals.

According to a further aspect of the invention, there is provided a method of making one or many directional drilled micro laterals from a main bore of a well using flush OD concentric set of tubes, with a direction drilling drill head and fluid powered drill bit, with the junction sealed by swellable elastomer, to significantly increase reservoir contact.

By way of example the following figures will be used to describe embodiments of the invention.

FIG. 7 is a section side view of detail C of FIG. 3 showing the positive displacement motor and the directional indexing piston.

FIG. 8 is a section side view of detail D of FIG. 4 showing the positive displacement motor and the directional indexing piston.

FIG. 9 is a section end view of FIG. 7 at section XX.

FIG. 10 is a section end view of FIG. 8 at section YY.

Figure 24A:
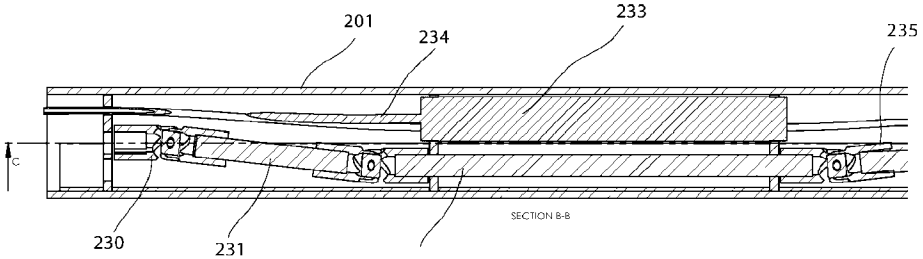

FIG. 24*a,b* is a section side view of an alternative directional drilling assembly.

Figures 23, 24B, 25B:
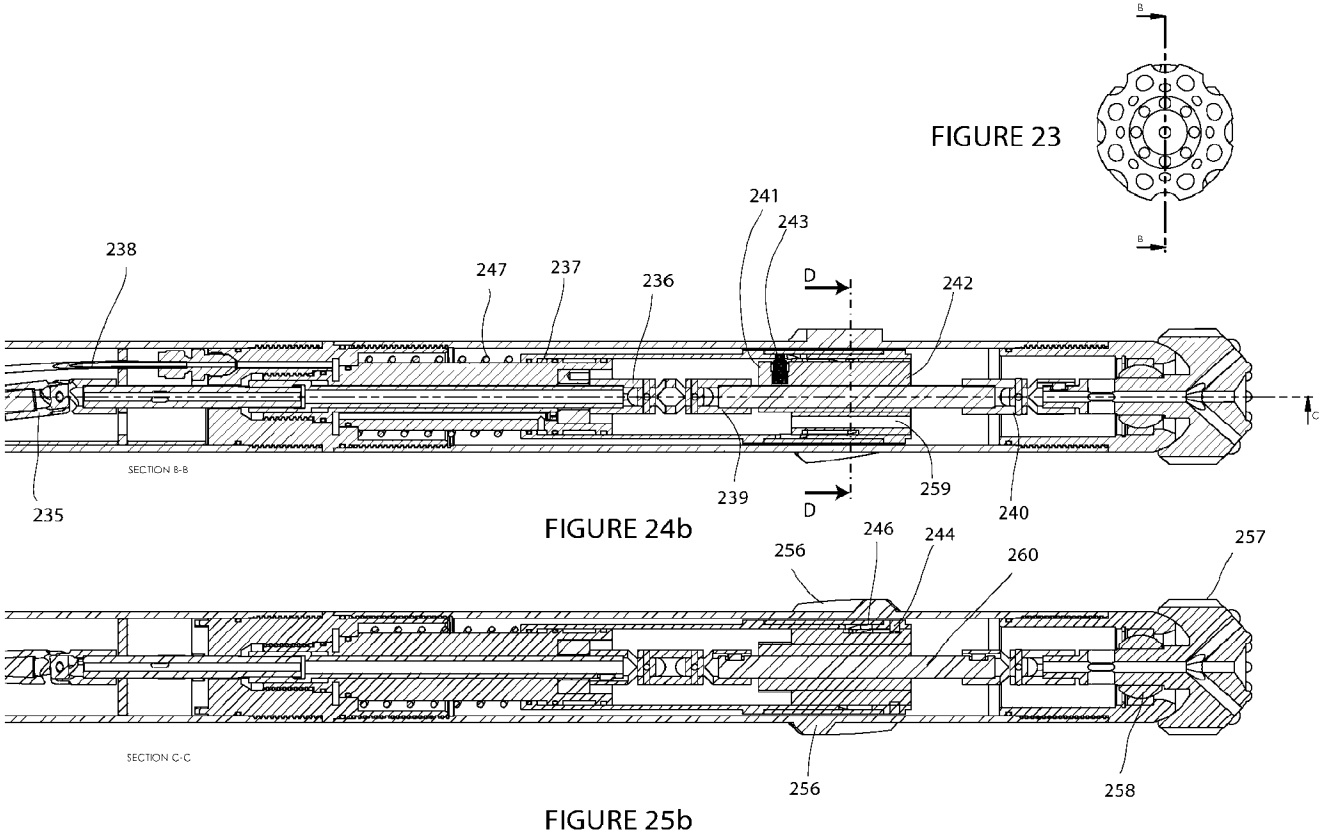
FIG. 23 is the front view of the drill bit.
Figure 25A:
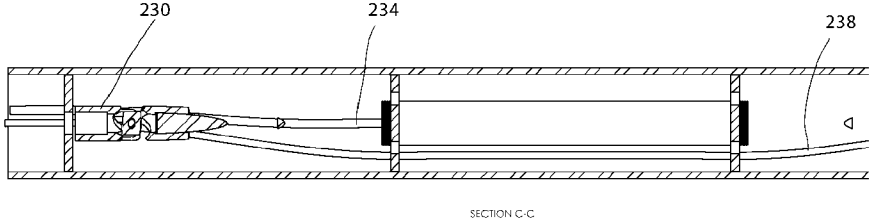

FIG. 25*a,b* is a section top view of the directional drilling assembly shown in FIG. 24.

Figure 26:
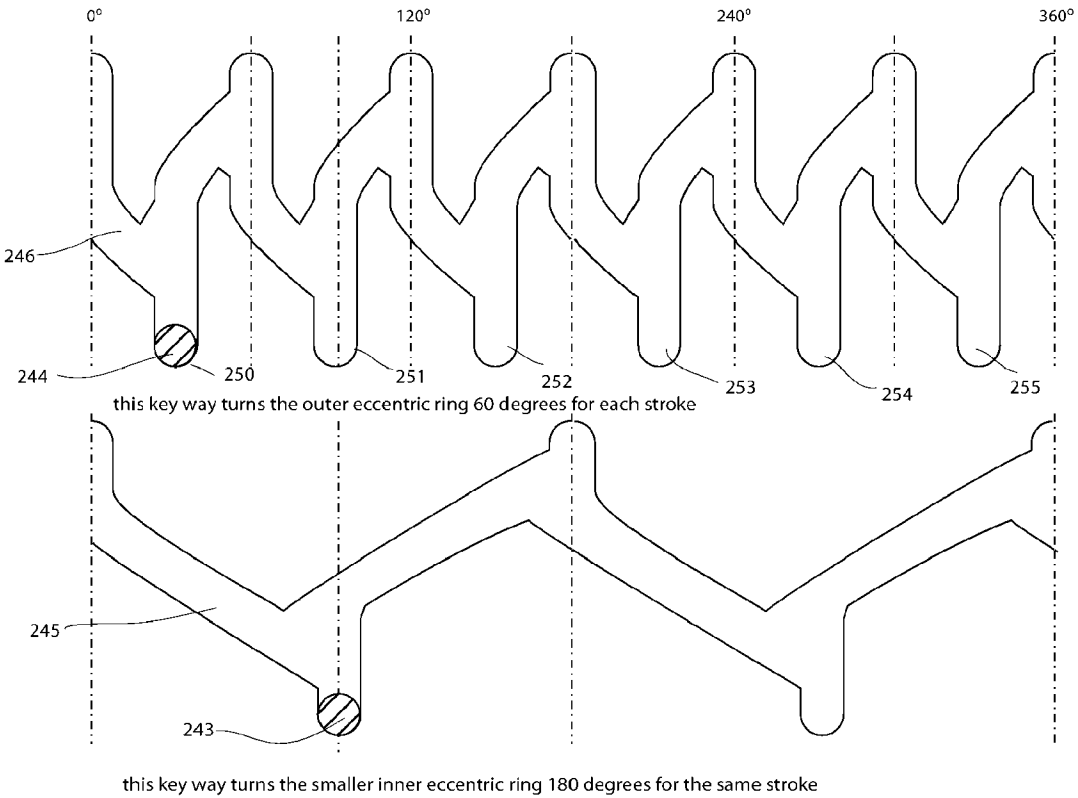

FIG. 26 is the two J slots at section DD laid flat.

Figures 27A, 27B, 27C:
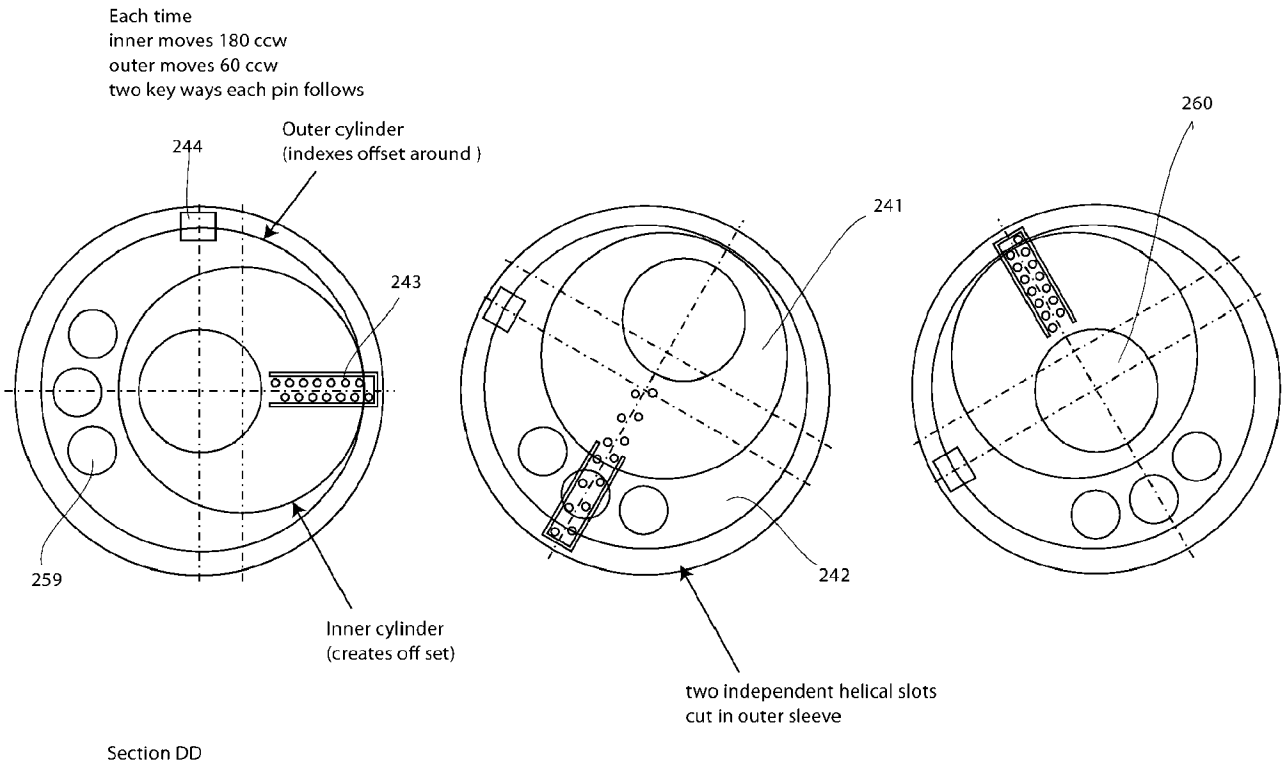
Figure 27D:
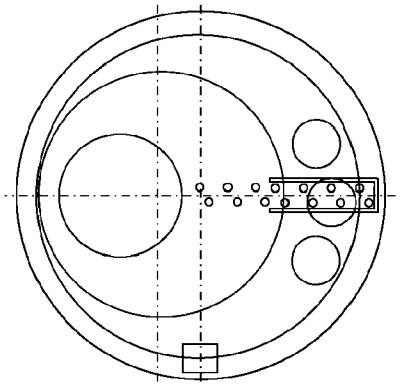
Figure 27E:
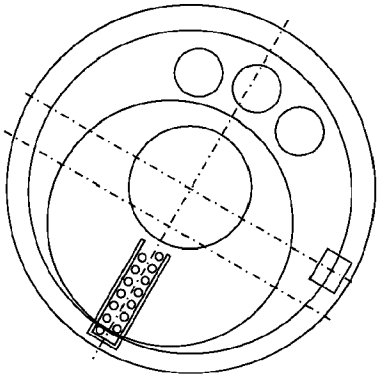
Figure 27F:
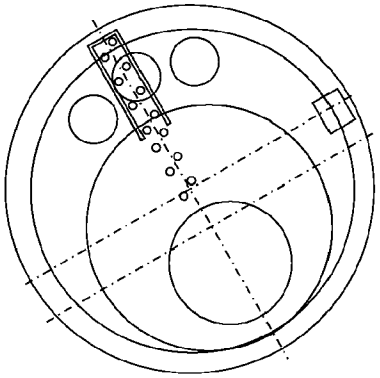

FIGS. 27*a,b,c,d,e,f* are end view of section DD with the two eccentric discs and J pins in its 6 respective operating positions.

Figure 1:
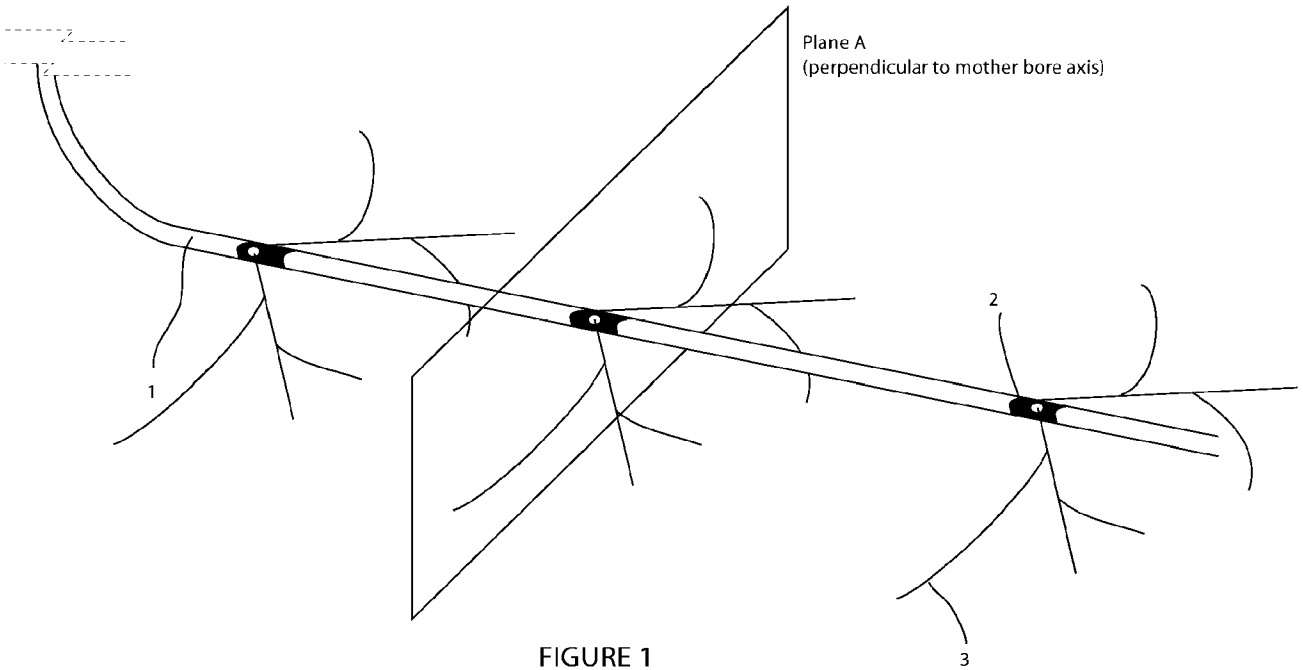
FIG. 1 is a isometric view of a horizontal well, with swellable packers, and extending though the swellable packers are directional drilled micro lateral.
Figure 2:
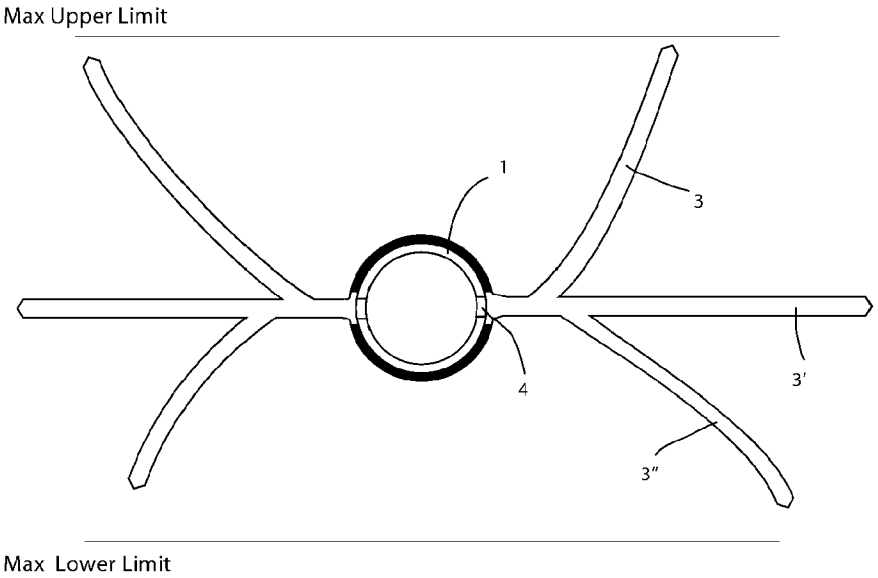
FIG. 2 is a view of plane A shown in FIG. 1, which is perpendicular to the mother bore, showing the directional micro laterals exiting through the casing and swellable packer and penetrating the reservoir.
Figure 3:
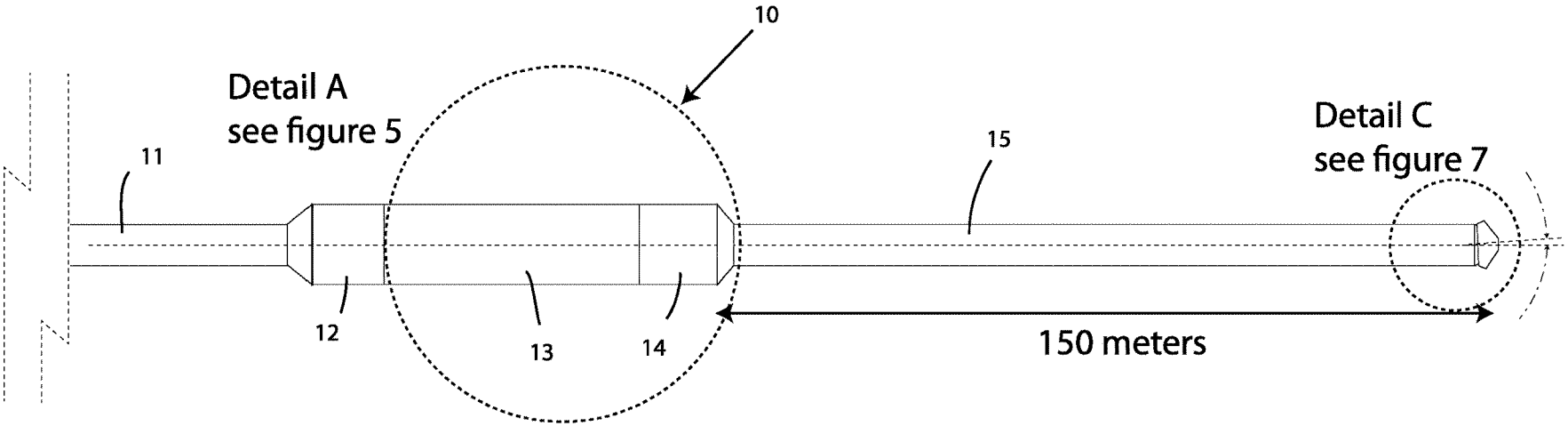
FIG. 3 is a side view of the downhole drilling assembly components, arranged to drill directionally.
Figure 4:
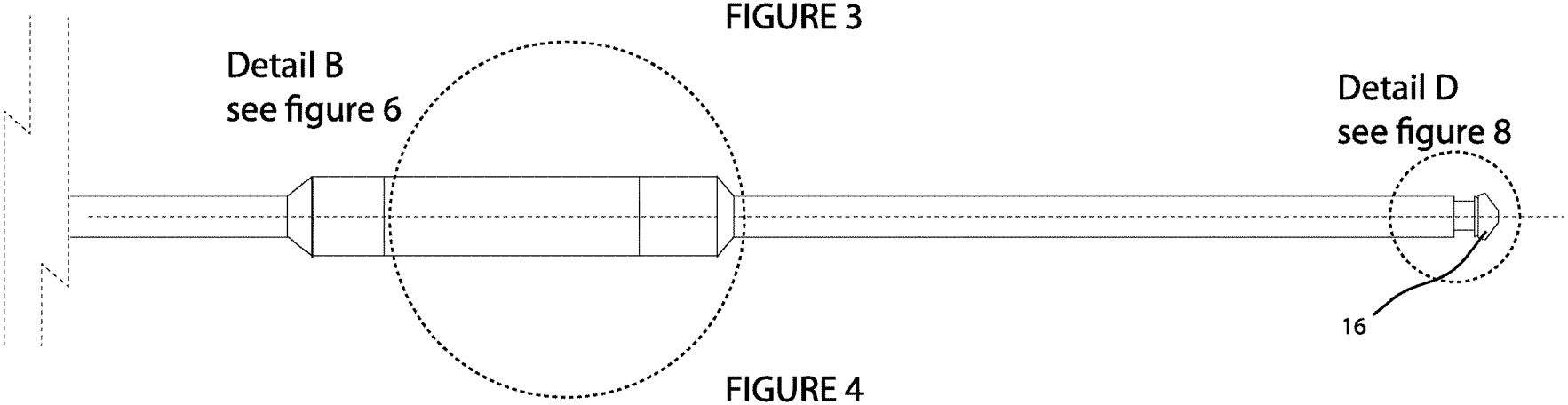
FIG. 4 is a similar view to FIG. 3 arranged to drill in a straight path.
Figure 5:
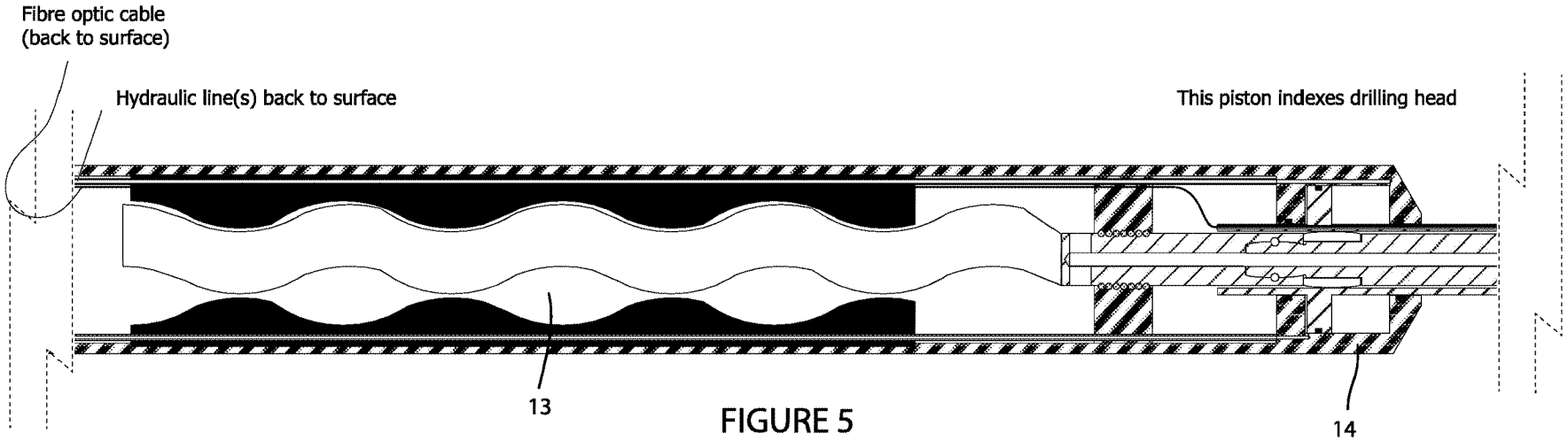
FIG. 5 is a section side view of detail A of FIG. 3 showing the positive displacement motor and the directional indexing piston.
Figure 6:
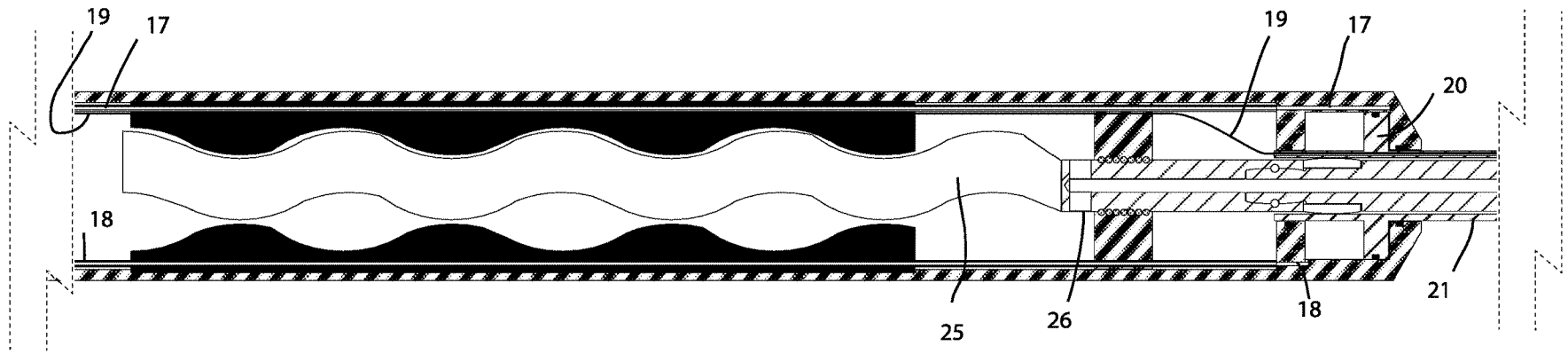
FIG. 6 is a section side view of detail B of FIG. 4 showing the positive displacement motor and the directional indexing piston.
Figure 11:
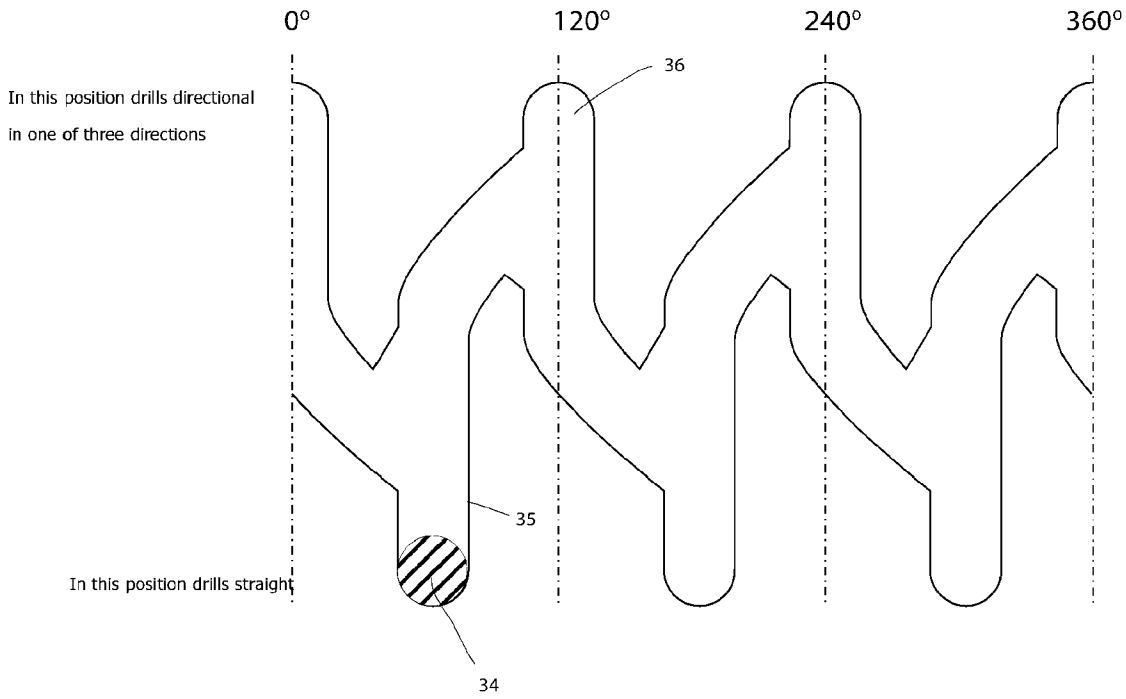
FIG. 11 is the indexing slot arrangement shown in FIG. 7-10.
Figure 12:
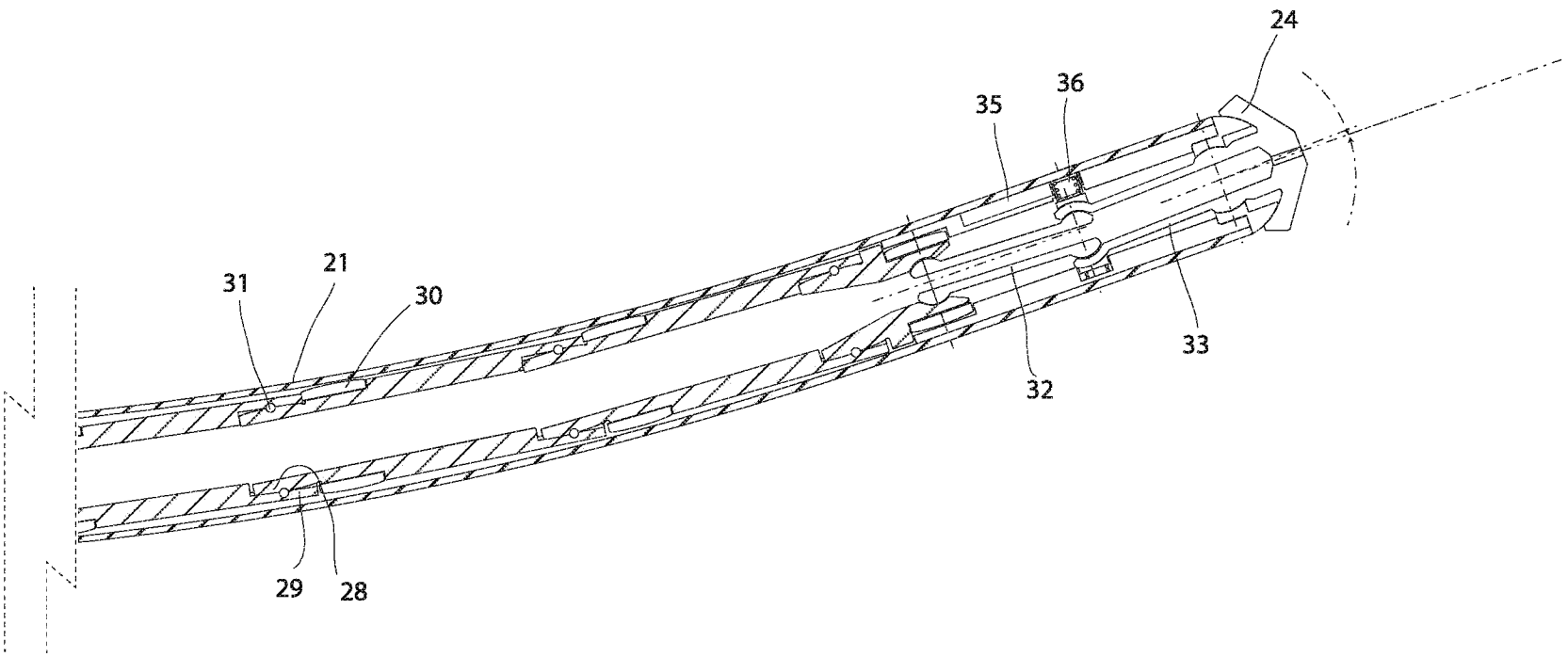
FIG. 12 is a section side view of the drilling assembly drilling a radius.
Figure 13:
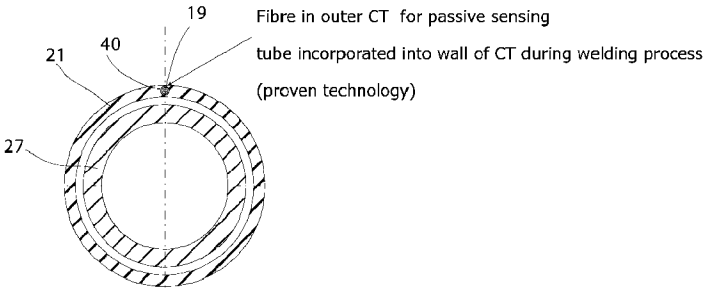
FIG. 13 is a section end view through the concentric drilling arrangement at section ZZ of 7.
Figure 14:
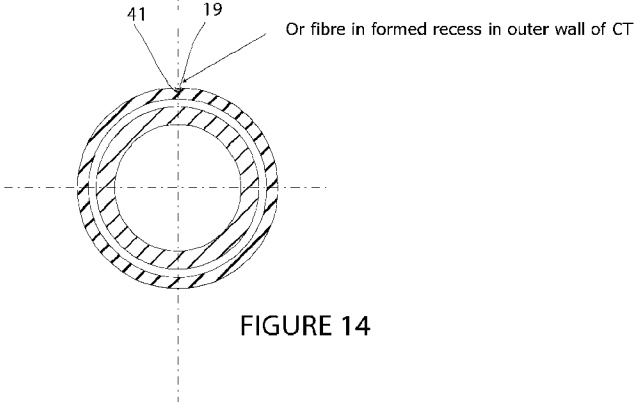
FIG. 14 is a similar view to FIG. 13 with a different embodiment.
Figure 15:
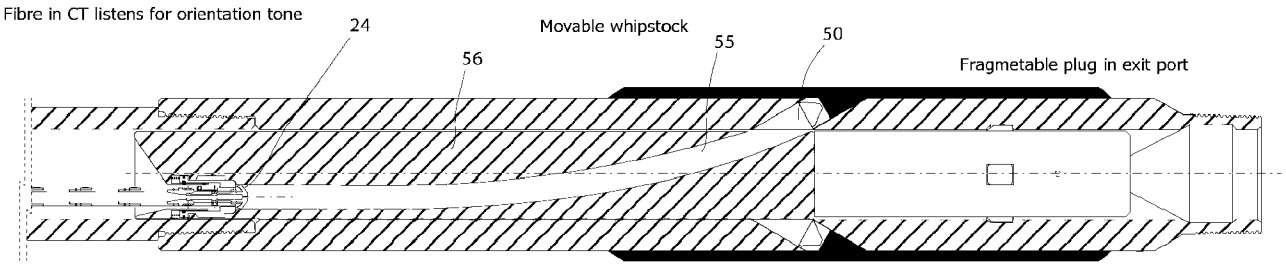
FIG. 15 is a section side view of a smart whipstock located at one of the exit ports in the completion.
Figure 16:
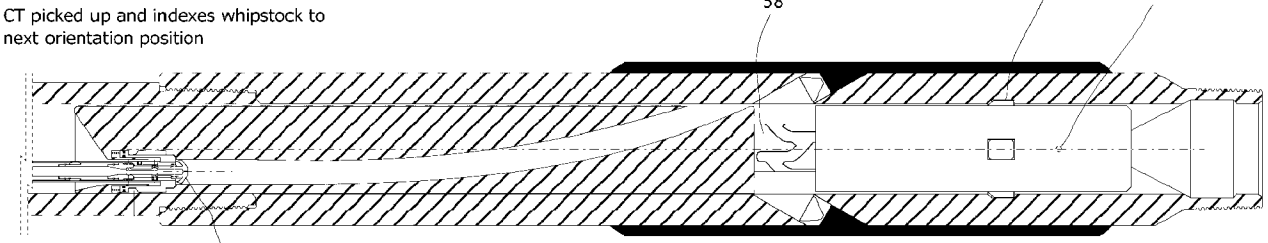
FIG. 16 is a similar view to FIG. 15 with the whipstock being indexed to a another exit port.

Referring to FIGS. 1 and 2 there is shown a casing or liner 1 in a horizontal wellbore (not shown), and along its length are micro laterals 3 extending from the casing through swellable packers 2. The casing has exit ports 4 through which the micro drilling assembly exits. After the exit port the micro lateral can be drilled such as 3' and 3" in any controlled direction and more can be drilled after exiting the exit port 4.

Referring to FIGS. 3 to 14, there is shown a drilling assembly 10 deployed on coiled tubing 11, the drilling assembly consisting of a connector and release joint 12, a positive displacement motor 13, a hydraulic actuator 14 for directional steering the bit, and a long micro lateral drilling tube with a stationary outer and rotating inner 15, at the end of which is a directional drilling head 16. Through the stator of the motor 13, are moulded two hydraulic lines 17,18 and a fibre optic line 19. The hydraulic lines act on each side of a piston 20, which moves the outer coil 21 of the micro drilling from an extended position 22 to a withdrawn position 23. This is the method used to control the direction of the drilling head 24. The output shaft of the PDM 25 connects to the shaft 26 which transmits torque to the bit 24. This shaft consists of many short shafts 27 which have a crowned spline connection male 28 and female 29 at each end. These enable the shaft to bend yet still transmit torque. A ceramic bearing 30 uses the ID of the outer tube 21 to support the shaft. Each crowned splined coupling includes a bearing race 31 to lock the two components together. Torque is transmitted through to the bit via a articulated knuckle joint 32, 33. When the outer coiled tube is in the retracted position a spring loaded pin 34 is in a parked position in a J slot 35, when the outer coil is extended the pin goes into an active position 36 in which it pushes on one of three sides of a bearing support 37, depending on which side it is pushing the bit will be pointed in that direction. By simply reciprocating the outer coiled tubing, the bit can be indexed to drill in any direction. It will be appreciated, that the direction of rotation of the indexing mechanism is only one way. A drilling thrust bearing 38 is located a short distance behind the bit.

A fibre optic cable 19 is used for passive sensing of the drilling process and is either incorporated into a small tube 40 embedded into the wall of the outer coiled tubing, or retained in a shallow channel 41 in the wall of the outer coiled tubing 21.

Figure 17:
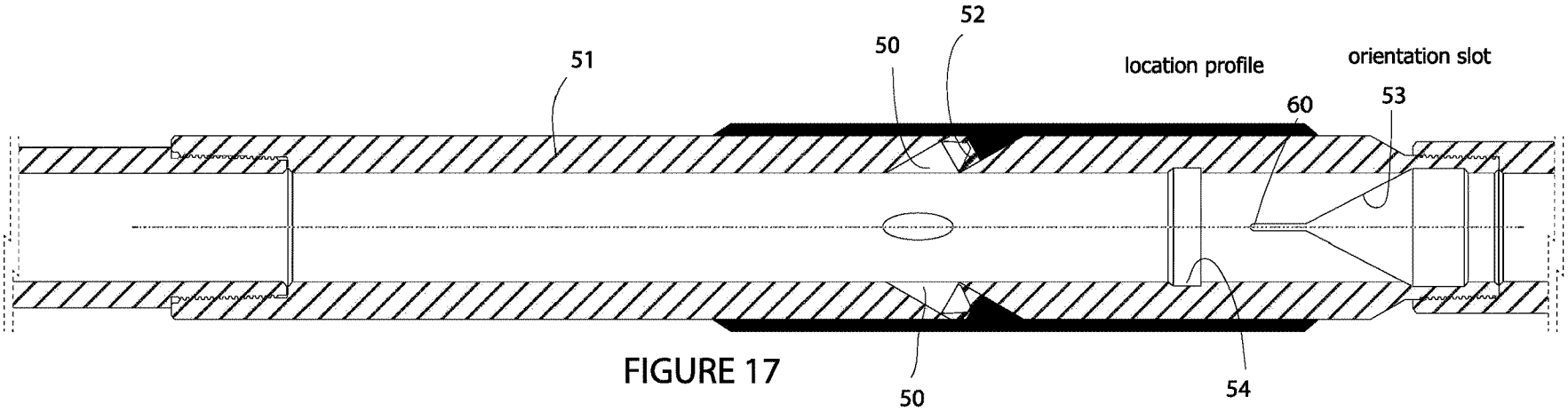
FIG. 17 is a similar view to FIG. 15 with the smart whipstock removed and exit ports, orientation profile and locating profile clearly visible.

Referring to FIGS. 15 to 19 there is shown several embodiments of whip stock. FIG. 17 shows exit ports 50 in a casing tool 51. The exit port is sealed with a fragment able plug 52, this can withstand high external pressure, but is easily drilled by the drill bit 24. The outer surface of the casing tool 51 is covered with swellable packer material; this is used to seal the open hole and the outer surface of tool 51, which effectively isolate each micro lateral. Inside the tool is a simple orientation profile 53 and location profile 54.

A smart whip stock tool is located in the lower most micro lateral exit. The whip stock passage 55 is aligned with an exit port. The micro lateral drilling head 24 enters the passage 55. Inside the smart whip stock 56 is a simple means which determines its orientation relative the vertical axis. This transmits a tone unique for each degree. The fibre optic cable 19 which is in the wall of the outer coil 21 detects this tone and it is communicated back to surface via an interrogator situated at surface. If the exit port is not in the correct position, the micro lateral drilling assembly can be used to index the smart whip stock to the next exit port. The micro drilling head locates in a profile 57 of the smart whip stock 56. Continuing to pick up and the smart whip stock extends and operates a indexing j slot 58. The lower dogs 59 which locate in the profile 54, have a hydraulic time delay before they unseat, so provided the smart which stock can be lowered back down in the required time interval the lower dogs remain set. In the tool shown in FIG. 17 there are 4 exit ports set at 90 degrees to one another, so regardless of the casing orientation, it should be possible to select a suitable exit port for the reservoir target. After drilling the required number of micro laterals at this tool, the micro drilling head is picked up and an overpull is maintained until lower dogs 59 and orientation pin 60 unset and the assembly can be moved to a exit port tool higher up the well. If the micro lateral drilling assembly has to be recovered to surface for a change out, it is possible to disconnect it from the smart whipstock. This is achieved by fully extending the outer coil 22, this closes the recess in which the mechanism 57 locates.

Figure 18:
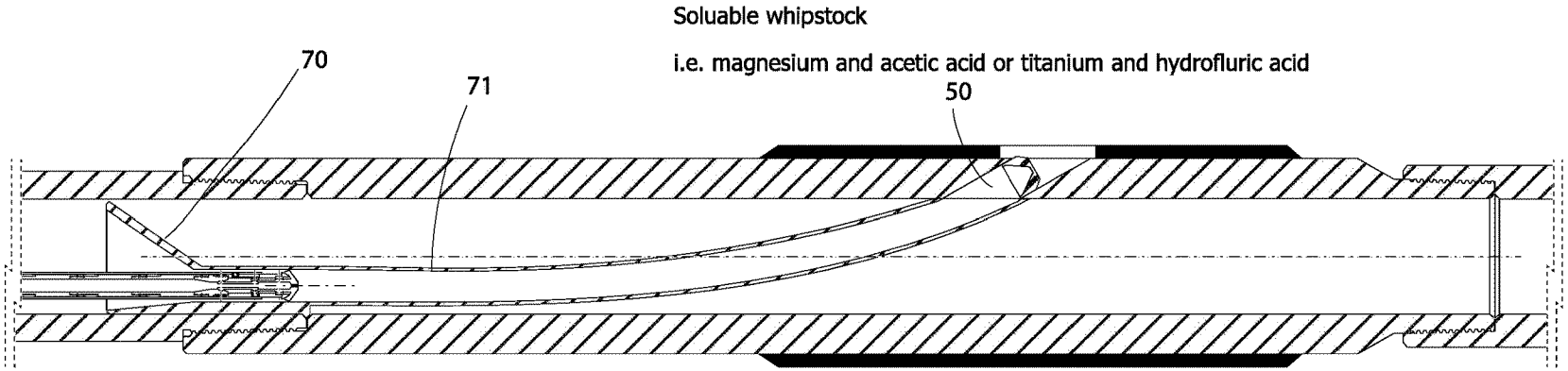
FIG. 18 is a section side view through the casing showing another whipstock embodiment.

Referring to FIG. 18 there is a further embodiment of the whipstock invention, the whipstock consists of a guide funnel 70 a whipstock tube 71 to guide the drilling assembly to the exit port 50. Both the guide funnel and whipstock tube are made from magnesium or titanium, both of which are soluble to acids acetic and hydrofluoric acid respectively. Once access to the exit port is complete, acid is circulated to the drilling head and the whip stock is dissolved.

Figure 19:
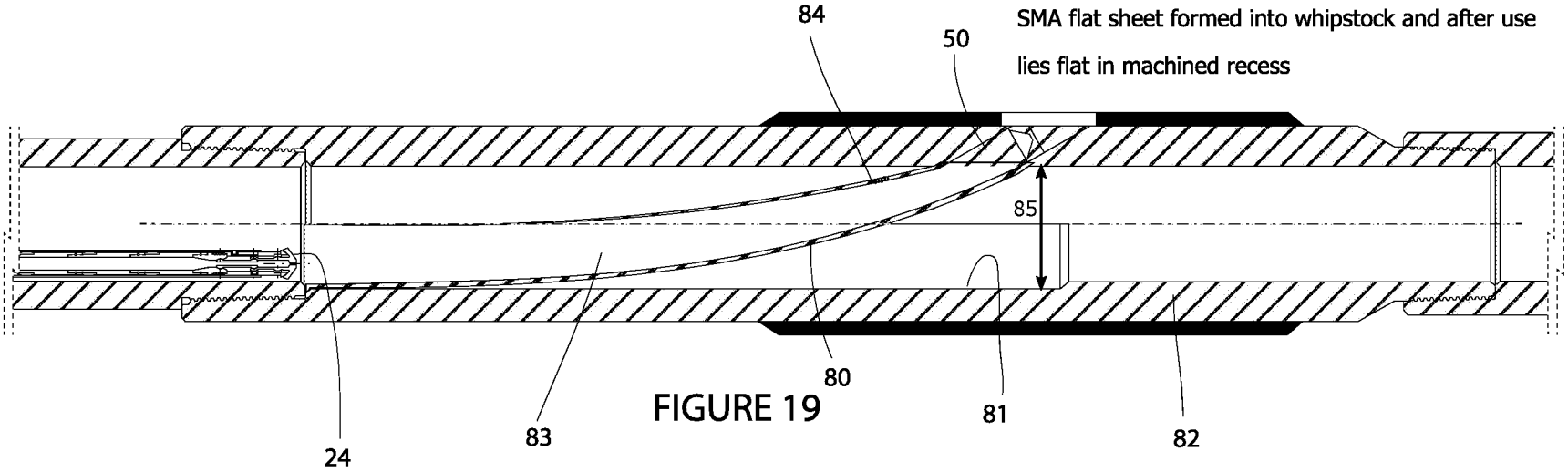
FIG. 19 is a section side view through the casing showing yet another whipstock embodiment.
Figure 20:
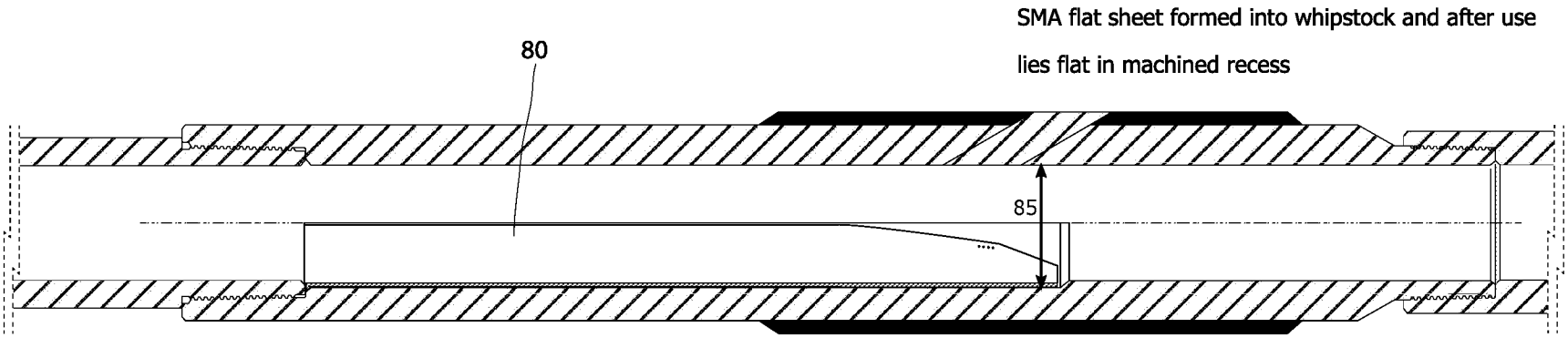
FIG. 20 is a section side view through the casing showing the whipstock embodiment in FIG. 19 in a deactivated mode.

Referring to FIGS. 19 and 20, the whip stock consists of a sheet 80 of shape memory alloy material which when released from its whip stock shape locates into the machined half-moon shaped recess 81 of the tool 82. The drilling head 24, rides up on the curved surface 83, at about the position 84 the curved surface fully encases the drilling assembly 24 and guides it into the exit port. Sharp edges on the larger diameter 85 contacts the lead surface reaches the point 84, it unzips the retaining mechanism and the SMA sheet 83 then unfolds and locates in the recess 81. The drilling assembly can then be retracted from the exit port and moved down to the next exit port.

Figure 21:
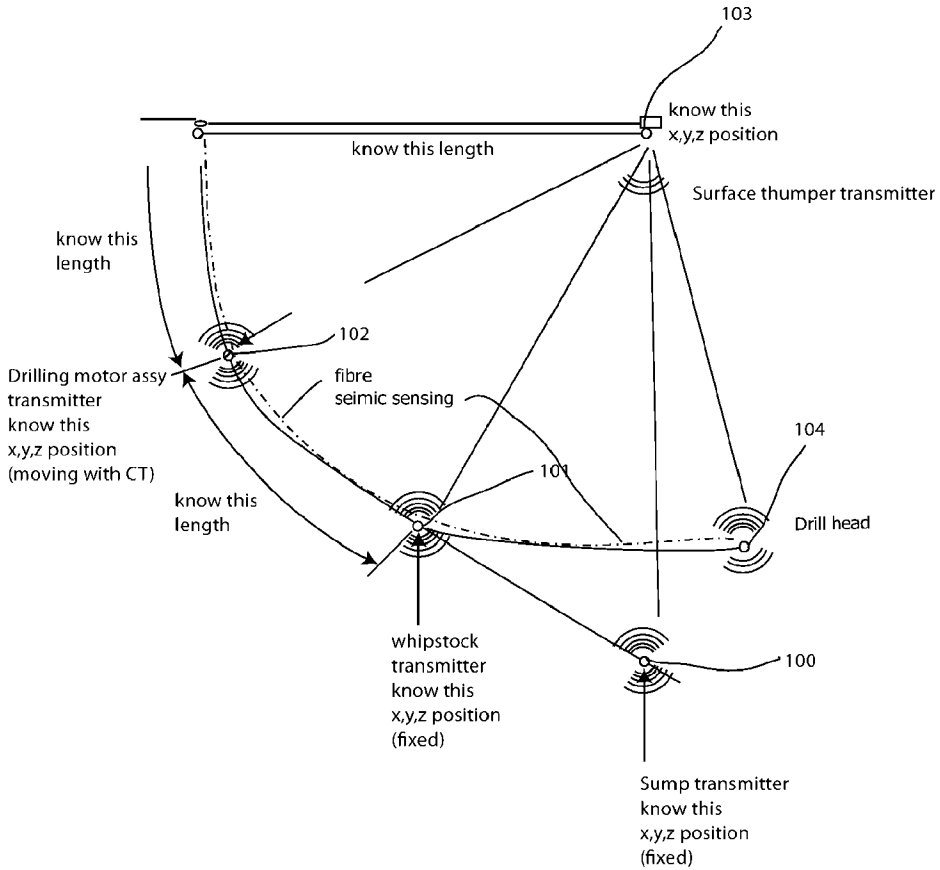
FIG. 21 is an isometric view of the well and shows how the acoustic measurement made with the fibre optics is used to accurately determine the path of the micro lateral, and ensure it is precisely positioned.
Figure 22:
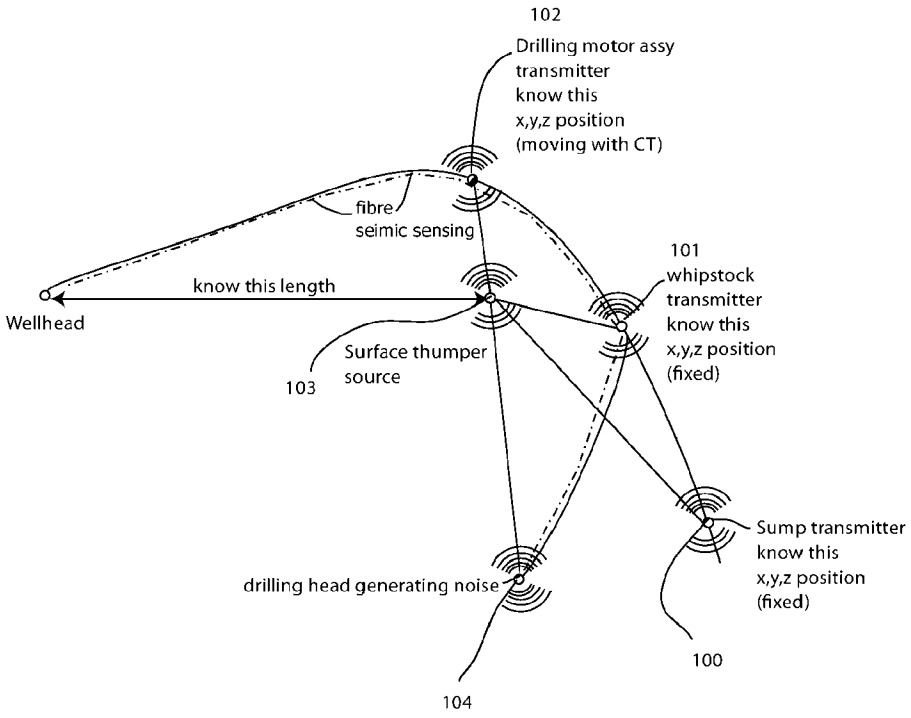
FIG. 22 is a plan view of the well of the well shown in FIG. 20 and shows how the acoustic measurement made with the fibre optics is used to accurately determine the path of the micro lateral, and ensure it is precisely positioned.

Referring to FIGS. 21 and 22, advances with interrogating a fibre optic cable enable numerous measurements to be made. Seismic measurements are now possible, exploiting this technology, and by placing noise generating sources in know positions in the well and at surface, it is possible to accurately track the position of the drilling assembly in real time. By placing a battery or fluid powered noise source in the well sump 100, in the smart whip stock 101, above the drilling motor power section 102 and at surface 103, and the noise generated by the drilling head 104, it is possible to interrogate the fibre embedded in the wall of the coiled tubing and determine its precise position in real time. This totally passive measurement system takes up very little space, but enable sophisticated measurements to be made by a micro drilling system.

Referring to FIGS. 23 to 27 there is shown an alternative directional drilling head. The outer housing 201 does not turn, a drive shaft 230 231 connects to a universal coupling 231 joint to a shaft 232 and is directed around a sensor steering package 233 which is hard wired back to surface via sensor cable 234. On the other side of the sensor package the drive shaft is brought back onto the centre line of the tool via another universal coupling 235. The drive shaft 236 continues to the bit passing through a hydraulically powered annular piston 237, this is energised by a hydraulic line 238 which either goes back to surface or is powered locally (source of hydraulic power is not shown) The drive shaft 260 has a further two universal joints 239, 240, on either side of a point the bit mechanism. The point the bit mechanism consists of two eccentrically bored cylinders 241,242, and each is indexed by a pin 243, 244, in their respective slots 245, 246. As hydraulic fluid is pumped into piston 237, the piston is moved in the reward direct against a return spring 247. Each eccentrically bored cylinder rotates in a controlled manner to either point the bit along the axis of the tool, ie. To drill ahead, or at an angle each to the eccentric offset, in one of three directions off the centre line.

FIG. 26 shows the two indexing slots if they were laid out flat, so for each indexing operation the two indexing slots move the two eccentric bored cylinders to one of six positions, 250, 251, 252, 253, 254, 255.

Referring to FIGS. 27*a,b,c,d,e,f* there is shown the six positions possible by the indexing slots and the eccentric bored cylinders. For each charge of the chamber 237 the bit either faces the hole in a straight line or the bit is pointed in one of three directions 120 degrees away from the centre line.

A near bit stabiliser 256 provides support for the drill bit 257, the spherical ceramic journal bearing 258 can accommodate full drilling thrust and provides a near bit fulcrum to maximise the angle of kick off. Fluid passages 259 allow fluid to bypass the steering mechanism and get to the bit.

The invention claimed is:

1. A flush OD directional drilling apparatus for directionally drilling a lateral bore from a main bore, comprising a casing in the main bore, the casing having at least one lateral exit port, with a fragmentable plug, flush lateral directional drilling tube, and a pre-installed whipstock guide for guiding the flush lateral directional drilling tube into the lateral exit port to drill a directional lateral hole from the lateral exit port, wherein the exit port is located within a swellable packer.

2. The apparatus according to claim 1, wherein the whipstock is resettable.

3. The apparatus according to claim 1, wherein the whipstock may be orientated or rotated relative to the casing or bore.

4. The apparatus according to claim 1, wherein the whipstock is disposable.

5. The apparatus according to claim 1, wherein the whipstock is dissolvable.

6. The apparatus according to claim 1, wherein the drilling apparatus, once in the well, can drill many laterals in a single trip.

7. The apparatus according to claim 1, wherein fibre optic sensors are used as a passive sensor to determine the position of the drill head.

8. A flush OD directional drilling apparatus for directionally drilling a lateral bore from a main bore, comprising a casing in the main bore, the casing having at least one lateral exit port, with a fragmentable plug, flush lateral directional drilling tube, and a pre-installed whipstock guide for guiding the flush lateral directional drilling tube into the lateral exit port to drill a directional lateral hole from the lateral exit port, wherein the pre-installed whipstock transmits a tone for the angle at which it is set for exit.

9. The apparatus according to claim 8, wherein the tone is different for every 1-2 degrees relative to vertical, a fibre optic cable in the wall of a coiled tubing detects the tone and an interrogator at surface can interrupt this information.

10. The apparatus according to claim 9, wherein the whipstock is resettable.

11. The apparatus according to claim 9, wherein the whipstock may be orientated or rotated relative to the casing or bore.

12. The apparatus according to claim 9, wherein the whipstock is disposable.

13. The apparatus according to claim 9, wherein the whipstock is dissolvable.

14. The apparatus according to claim 9, wherein the drilling apparatus, once in the well, can drill many laterals in a single trip.

15. A flush OD directional drilling apparatus for directionally drilling a lateral bore from a main bore, comprising a casing in the main bore, the casing having at least one lateral exit port, with a fragmentable plug, flush lateral directional drilling tube, and a pre-installed whipstock guide for guiding the flush lateral directional drilling tube into the lateral exit port to drill a directional lateral hole from the lateral exit port, wherein a noise transmitter is included in the pre-installed whipstock, a distance below the pre-installed whipstock, at a motor and at surface to enable the exact position of a coiled tubing in the lateral to be determined and therefore enable the micro lateral to be directionally drilled.

16. The apparatus according to claim 15, wherein the whipstock is resettable.

17. The apparatus according to claim 15, wherein the whipstock may be orientated or rotated relative to the casing or bore.

18. The apparatus according to claim 15, wherein the whipstock is disposable.

19. The apparatus according to claim 15, wherein the whipstock is dissolvable.

20. The apparatus according to claim 15, wherein the drilling apparatus, once in the well, can drill many laterals in a single trip.

21. The apparatus according to claim 15, wherein fibre optic sensors are used as a passive sensor to determine the position of the drill head.

* * * * *